US005571001A

United States Patent [19]

Fukuda et al.

[11] Patent Number: 5,571,001

[45] Date of Patent: Nov. 5, 1996

[54] ELECTRICALLY-POWERED WATER-IMMERSED PUMP

[75] Inventors: Tetsuya Fukuda; Yoshiaki Yamada, both of Yamaguchi, Japan

[73] Assignees: Taiko Kikai Industries Co., Ltd., Yamaguchi; Japanese Marine Equipment Association, Tokyo, both of Japan

[21] Appl. No.: 568,223

[22] Filed: Dec. 6, 1995

[30] Foreign Application Priority Data

Oct. 12, 1995 [JP] Japan ..... 7-264426

[51] Int. Cl.[6] ..... F04B 17/00

[52] U.S. Cl. ..... 417/423.3; 417/423.8; 417/423.13

[58] Field of Search ..... 417/423.3, 423.6, 417/423.7, 423.8, 423.13, 423.14, 424.1

[56] References Cited

U.S. PATENT DOCUMENTS 2,492,141 12/1949 Gaylord ..... 417/423.3 X
4,293,288 10/1981 Weber ..... 417/423.3 X
4,948,348 8/1990 Doll et al. ..... 417/423.3 X
5,336,064 8/1994 Lamers ..... 417/423.3

*Primary Examiner*—Richard E. Gluck
*Attorney, Agent, or Firm*—Lowe, Price, LeBlanc & Becker

[57] ABSTRACT

A pressure-resistant explosion-proof electric motor (44) is surrounded by a double casing comprised of inner and outer cases with a motor-cooling oil passage (54) formed therebetween. A flange (26) is detachably fitted to the top surface of a tank to hold the electric motor (44) in the tank. A downwardly-extending pipe (28) is at an upper end fixed to the flange and at a lower end connected through a terminal box (30) to the electric motor (44). A centrifugal pump (67) is fixed to the underside of the electric motor (44) to have its rotary shaft connected to the output shaft (60) of the electric motor (44). A motor cover accommodates therein the electric motor and the terminal box (30) in a watertight manner. A protective pipe (71) extends from the flange (26) to the motor cover (69) and accommodates therein the downwardly-extending pipe (28) in a watertight manner. A cooling oil is circulated through the motor-cooling oil passage (54) to cool the electric motor. This water-immersed cargo handling pump is suitable for transferring the liquid in a tank of a vessel.

6 Claims, 7 Drawing Sheets

ELECTRICALLY-POWERED WATER-IMMERSED PUMP

BACKGROUND OF THE INVENTION

1. Field of the Invention

This invention relates to a cargo handling pump for transferring the liquid contained in a tank of a vessel or the like.

2. Description of the Related Art

FIG. 6 is a longitudinal sectional view showing a conventional cargo handling pump for transferring a liquid cargo loaded in a vessel tank T.

This cargo handling pump A includes an electric motor 1 disposed above the tank T, a pump 2 disposed at the bottom of the tank T, and a plurality of intermediate shafts 3 which connect the electric motor 1 and the pump 2.

The electric motor 1 is mounted on a motor mount 4 which is detachably fitted on the top surface of the tank T. Couplings 5 and intermediate shafts 3 are alternately connected to the output shaft 1*a* of the electric motor 1. Protective pipes 6 and bearings 7 are alternately fitted to the underside of the motor mount 4. A centrifugal pump 2 has an end surface thereof fixed to the lowermost protective pipe 6.

The first intermediate shaft 3, the one connected to the output shaft 1*a*, is supported by a bearing 8 provided in the motor mount 4, while the other intermediate shafts 3 are supported by bearings 7. The lowermost intermediate shaft 3 is connected to the rotary shaft 9 of the centrifugal pump 2, and a discharge pipe 10 connected to the centrifugal pump 2 extends through the top surface of the tank T and opens to the outside. The bearings 7 are arranged such that the intermediate shafts 3 are aligned with each other in a straight line.

If the electric motor 1, after fitting of the thus constructed cargo handling pump A to the tank T, is rotated, an impeller 11 fixed around the rotary shaft 9 is rotated to suck in ambient liquid from the suction side 12 of the centrifugal pump 2 and transfer same via the discharge pipe 10 to the outside of the tank T.

In this case, however, since the tank T has a large size, the entire length of the intermediate shafts 3 between the electric motor 1 and the centrifugal pump 2 is prolonged, thereby requiring an increased number of bearings 7 for supporting the intermediate shafts 3. Thus, a problem arises that the cargo handling pump A requires a large number of parts and its overall weight is increased. Further, due to the structure in which each intermediate shaft 3 is enclosed in the protective pipe 6, it is difficult to perform fine adjustment for centering and aligning the intermediate shafts 3.

Consequently, in case the intermediate shafts 3 are not co-axial, unwanted vibrations are apt to be caused, leading to damage to bearings 7 and to possible trouble during operation of the cargo handling pump. Under these circumstances, a cargo handling pump A1 of the hydraulically driven type as shown below is conventionally used.

The cargo handling pump A1, as shown in its longitudinal sectional view in FIG. 7, comprises a flange 13 fitted to the top surface of the tank T, a protective pipe 14 which is at the upper end fixed to the flange 13 and at the lower end connected with a motor cover 15 in a watertight manner, and a centrifugal pump 2 fixed at the upper end to the motor cover 15. An air chamber 16 is formed inside the protective pipe 14 and the motor cover 15, which air chamber is sealed against the liquid in the tank T. A hydraulic motor 17 is mounted on the upper end surface of the centrifugal pump 2 inside the motor cover 15 so that the rotary shaft 9 of the latter is connected to the output shaft of the hydraulic motor 17.

On the flange 13 is fixed a hydraulic head 18 where hydraulic pipeways are collected. An oil pipe extending from a hydraulic unit (not shown) located outside the tank T and functioning as a hydraulic source is connected to the hydraulic head 18, which hydraulic head is connected through a hydraulic pipe 19 to the hydraulic motor 17.

A branch pipe 20 extends from the hydraulic motor 17 to a bearing 21 for the rotary shaft 9 and to a shaft seal packing 22. The oil having been used to lubricate the bearing 21 is fed through an oil return pipe 23 to the hydraulic head 18. The oil having leaked from the shaft seal packing 22 is contained in a drain receiver 24 provided in the centrifugal pump 2. Air pressure from a pressure source (not shown) located outside is supplied through the protective pipe 14 to the air chamber 16, and from there further to the drain receiver 24 to take the oil in the drain receiver 24 along therewith through an air return pipe 25 to the outside of the tank T.

If hydraulic pressure is supplied from the hydraulic unit through the hydraulic head 18 to the hydraulic motor 17, the hydraulic motor 17 and thus the rotary shaft 9 are rotated to suck in the liquid from the suction side 12 of the centrifugal pump 2 and discharge same through a discharge pipe 10 to the outside of the tank T.

The cargo handling pump A1 as described above is advantageous in that, since no such intermediate shafts 3 as shown in FIG. 6 are used, no vibrations are caused, and that damage to such bearings as 7 and 8 in FIG. 6 can be neglected. The cargo handling pump A1, however, still has drawbacks such as those mentioned below.

(1) The hydraulic unit produces loud noises during its operation which are almost intolerable to inboard residents as well as workers inside and outside the vessel, and has been required to be improved in this respect.

(2) The mechanical efficiency of the hydraulic unit is very low, leading to the loss of lots of energy.

(3) The piping of the high pressure oil and the installation of the hydraulic pressure control equipment are complicated.

(4) The hydraulic motor has an upper limit in the number of revolutions, resulting in the discharge lift of the cargo handling pump limited. For a greater lift a costly two-stage impeller structure must be provided.

SUMMARY OF THE INVENTION

This invention has been accomplished to overcome the above drawbacks and an object of this invention is to provide a cargo handling pump which does not cause unwanted vibrations and is free from damage to bearings, which has a high mechanical efficiency, which does not cause loud noises, and which can be continuously operated for a long period of time.

In order to attain the object, an electrically-powered water-immersed pump of this invention comprises: a pressure-resistant explosion-proof electric motor enclosed by a double casing comprised of inner and outer cases with a motor-cooling oil passage formed therebetween, the outer case being at upper and lower ends closed in a watertight manner respectively by upper and lower lids between which an output shaft of the electric motor is rotatably held; a flange detachably fitted to a top surface of a tank containing a liquid to be transferred; a downwardly-extending pipe which is at an upper end fixed to the flange and at a lower end connected through a terminal box to the electric motor; a pump with a casing which is at an end surface fixed to an underside of the electric motor and with a rotary shaft which is connected to the output shaft of the electric motor; a cylindrically-shaped motor cover immersed in the liquid in the tank and accommodating therein the electric motor and the terminal box in a watertight manner; a protective pipe extending from the flange to an upper end of the motor cover and accommodating therein the downwardly-extending pipe in a watertight manner; a cooling-oil inlet pipe which communicates from a cooling-oil delivering pump located outside the tank through the flange to the motor-cooling oil passage inside the double casing of the electric motor; a cooling-oil outlet pipe which extends from the motor-cooling oil passage through the flange to open to the outside of the tank; and an electric cable which extends from a power source located outside the tank through the flange and the terminal box to the electric motor.

The outer peripheral surface of the inner case of the electric motor may be provided with spiral ribs to form the motor-cooling oil passage.

A lubricating oil passage may further be provided so as to extend from the cooling-oil inlet pipe for lubricating a bearing for the rotary shaft of the pump.

The electrically-powered water-immersed pump of this invention may further comprises a packing case which encloses therein a shaft seal packing portion for the rotary shaft of the pump in a watertight manner; a branch pipe extending from the cooling-oil inlet pipe to the shaft seal packing portion; a drain pipe communicating from the packing case to the outside of the tank; and an air pressure passage provided to communicate from outside the tank through the motor cover to the packing case, whereby the drain of the cooling oil leaked from the shaft seal packing portion is discharged by the air pressure through the drain pipe.

The rotary shaft of the pump may be mechanically integrally connected to an end of the output shaft of the electric motor.

Alternatively, the end surfaces of the rotary shaft of the pump and of the output shaft of the electric motor, which are of different materials, may be subjected to welding to be joined together.

The protective pipe, the motor cover and the centrifugal pump of the thus constructed electrically-powered water-immersed pump are supported in the tank when the flange is fitted to the top surface of the tank.

A water-tight air chamber is formed inside the protective pipe and the motor cover, in which air chamber the downwardly-extending pipe, the terminal box and the pressure-resistant explosion-proof electric motor are accommodated.

The electric motor is enclosed by a casing of double structure in which the motor-cooling oil passage is formed, thereby effectively insulating the running sound of the electric motor.

By operating the electric motor, the cargo-handling centrifugal pump is rotated, thereby to transfer the liquid through a discharge pipe to the outside of the tank.

The cooling oil delivering pump located outside the tank supplies the cooling oil through the cooling oil inlet pipe to the motor-cooling oil passage. The cooling oil then flows along the spiral ribs to remove the heat generated from the electric motor.

Part of the cooling oil is passed through the lubricating oil passage to lubricate the bearing for the rotary shaft of the pump.

The cooling oil supplied from the cooling-oil inlet pipe through the branch pipe to the shaft seal packing portion returns to the spirals inside the double casing of the electric motor after lubricating the shaft seal packing portion.

Thus, the oil supplied from the cooling-oil delivering pump performs three functions, i.e., cooling of the electric motor, lubricating of the bearing for the rotary shaft of the pump, and lubricating and cooling of the shaft seal packing.

Since the electric motor is maintained at below a certain temperature, same can be operated for a long period of time.

Since the output shaft of the electric motor and the shaft of the pump are subjected to mechanical connection or pressure welding to be integrally joined together, an error in the concentricity of the shafts is unlikely to take place.

The above and other objects, features and advantages of this invention will become apparent from the following description and the appended claims, taken in conjunction with the accompanying drawings in which like parts or elements are denoted by like reference characters.

DESCRIPTION OF THE PREFERRED EMBODIMENT

Embodiments of this invention will now be described with reference to the attached drawings.

Figure 1:
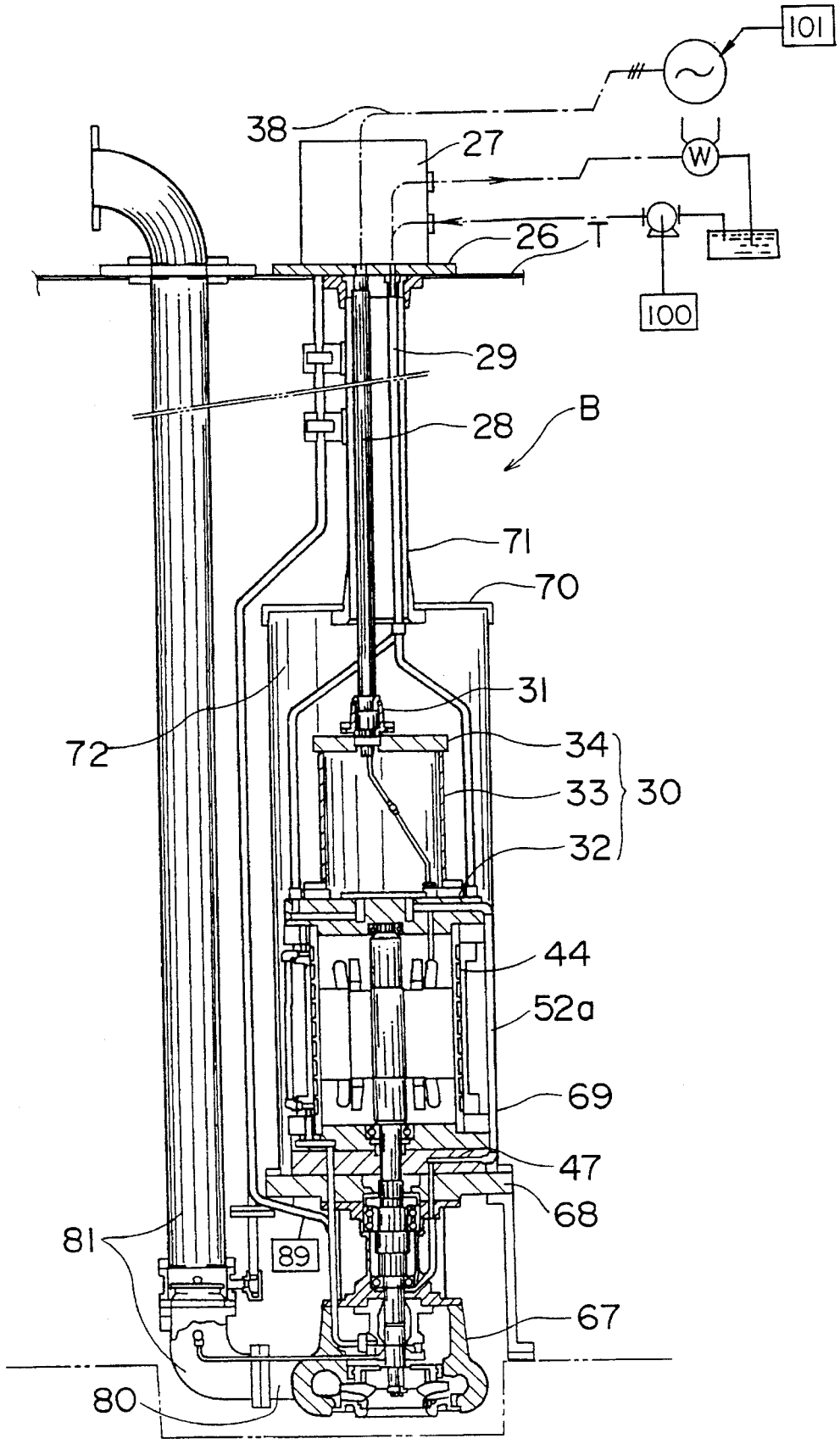
FIG. 1 is a longitudinal sectional view of an electrically-powered water-immersed pump according to one embodiment of this invention.
Figure 2:
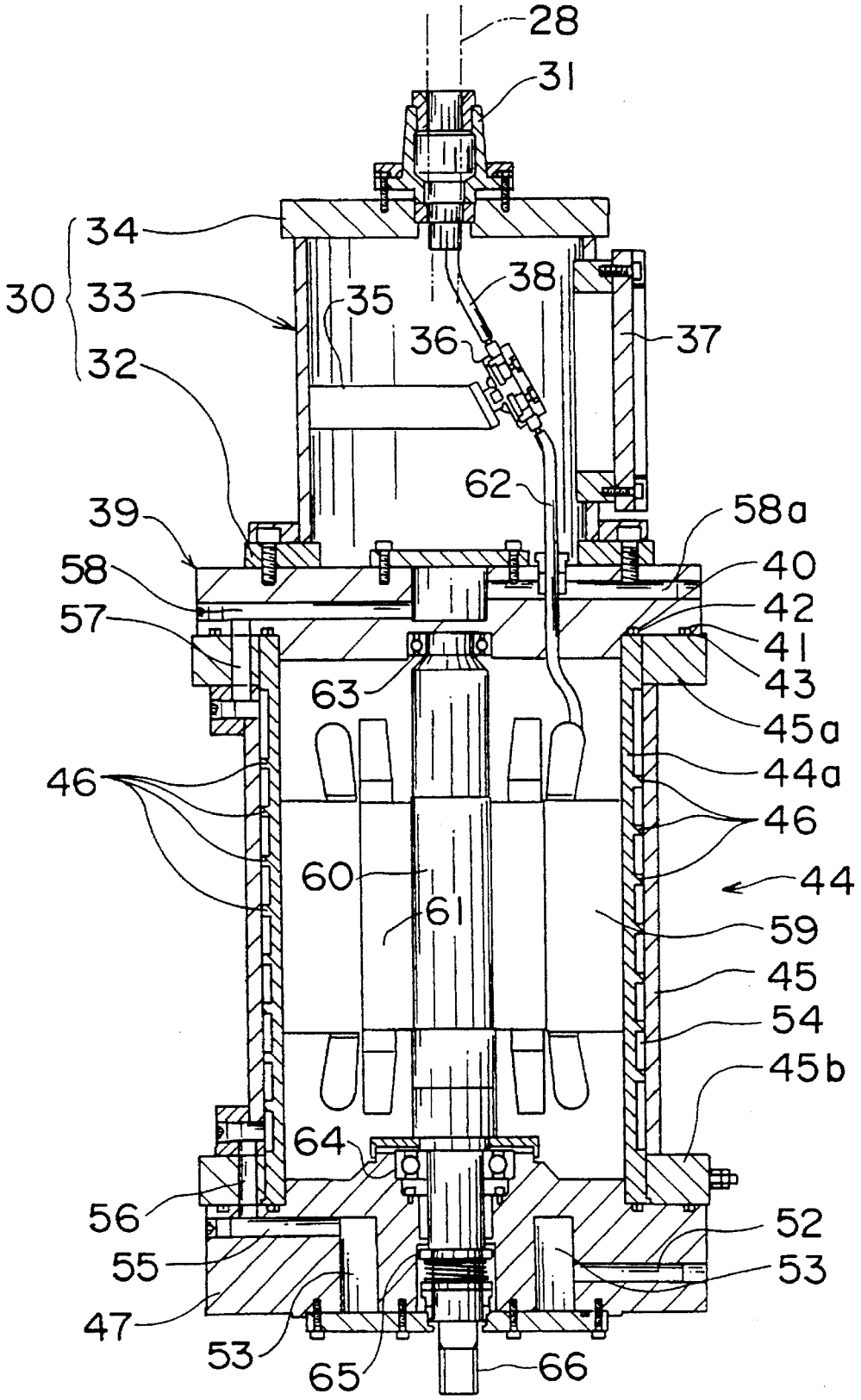
FIG. 2 is an enlarged view of a portion including an electric motor in FIG. 1.
Figure 3:
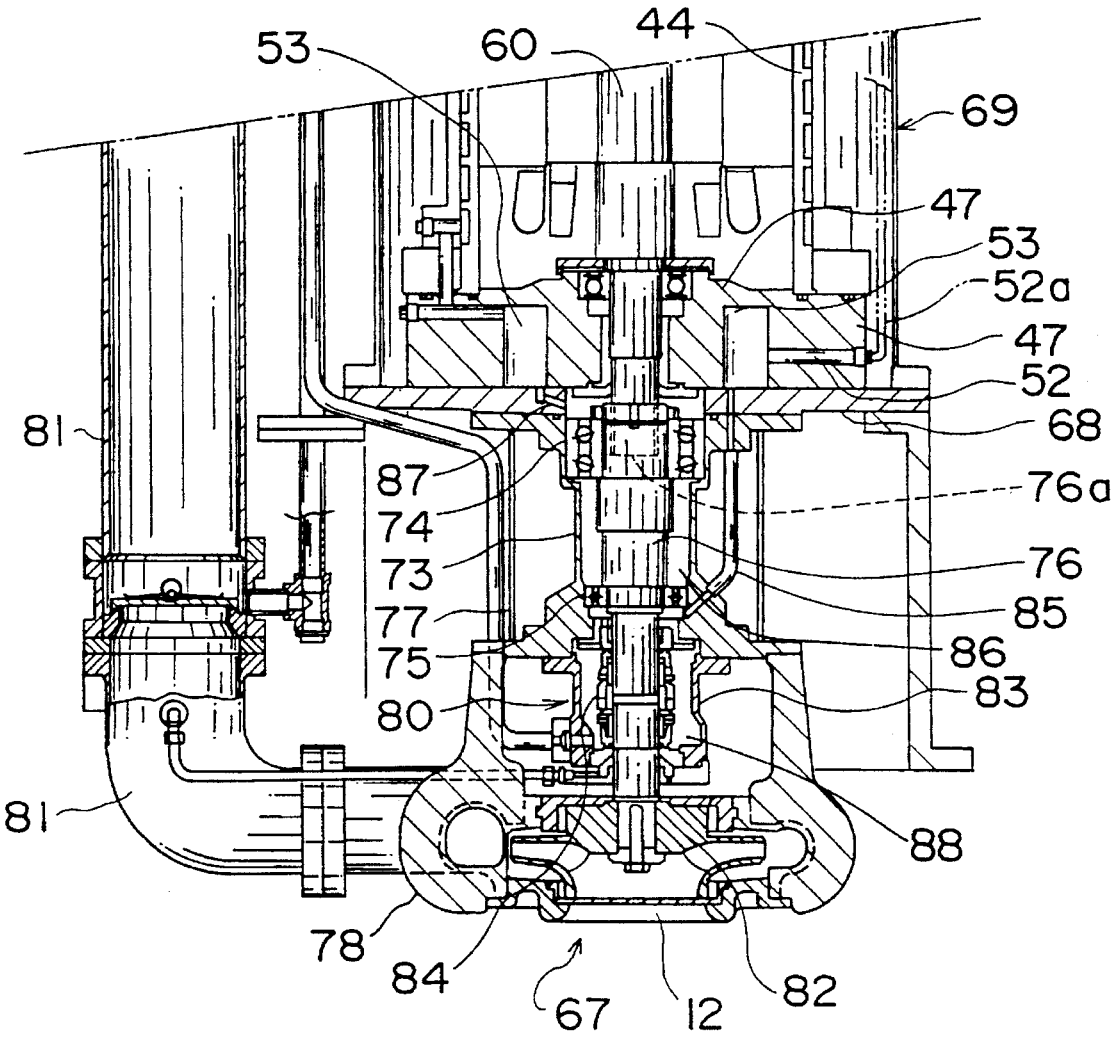
FIG. 3 is an enlarged view of a portion including a centrifugal pump in FIG. 1.

Referring to FIGS. 1 to 3, a flange 26 is detachably fitted to the top surface of a tank T, and a pipe- and wire-connection unit 27 is securely mounted thereon. Upper ends of a downwardly-extending pipe 28, a cooling-oil outlet pipe 29 and a cooling-oil inlet pipe **52*a* are inserted through the flange 26** to be fixed.

The downwardly-extending pipe 28 has its lower end connected to a terminal box 30 and sealed by a pipe seal member 31 fixed at an upper end of the terminal box 30 (FIGS. 1 and 2).

Figure 4:
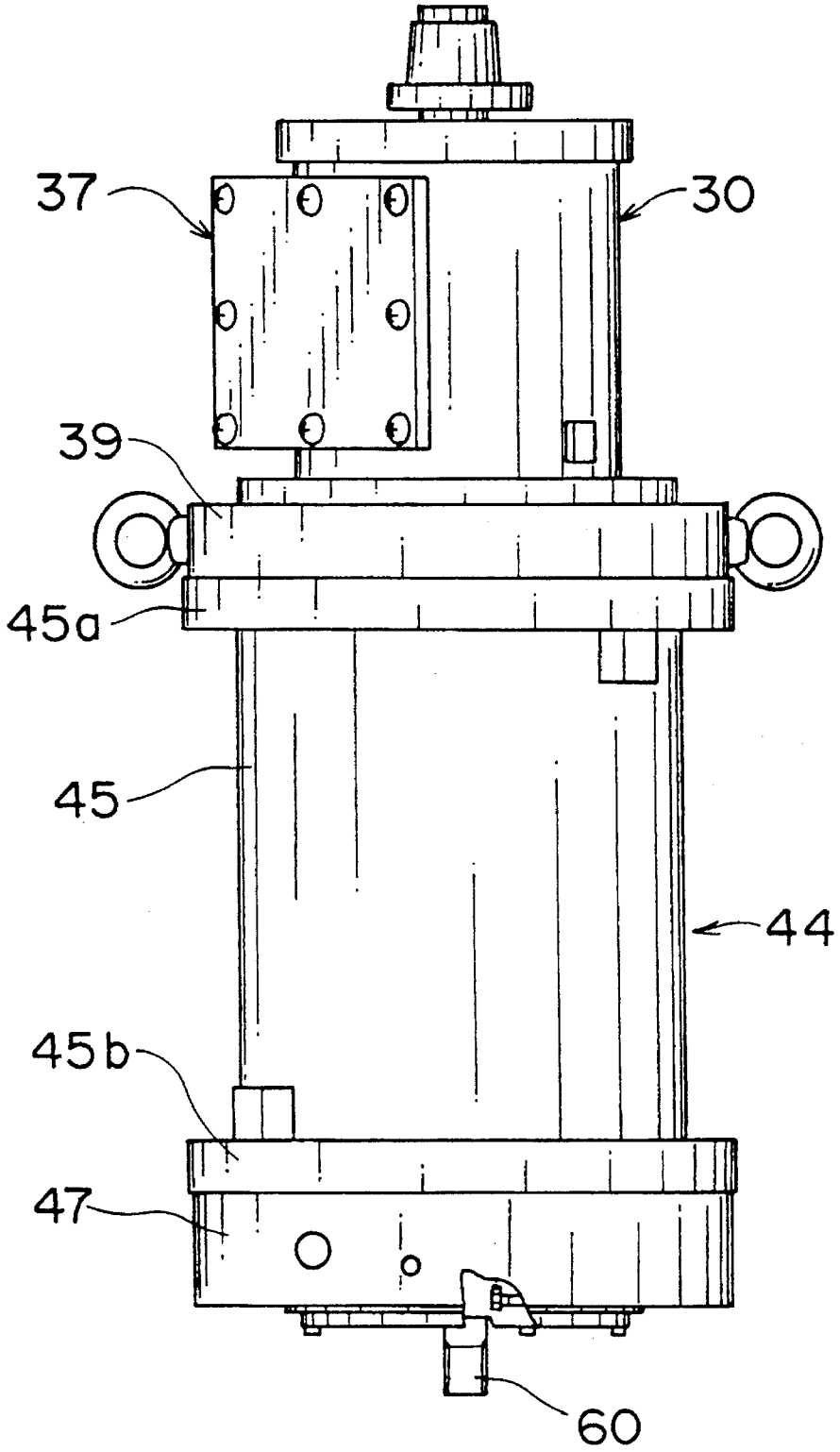
FIG. 4 is a front view of a terminal box and the electric motor.

The terminal box 30 comprises a base plate 32, side walls 33 standing upright thereon, and an upper wall 34 provided on the upper ends of the side walls 33. A terminal mount 36 is fitted to a support 35 which protrudes from an inner surface of one of the side walls 33. Another side wall 33 is provided with an opening for allowing a wire-connecting operation at the terminal mount 36 to be performed, which opening is normally closed by a terminal-box cover 37 screwed to the side wall 33 (FIGS. 2 and 4).

An electric wire 38 extending from a power source (not shown) on the top surface of the tank T is passed through the pipe- and wire-connection unit 27 and then through the downwardly-extending pipe 28 to be connected to the terminal mount 36 (FIGS. 1 and 2).

An upper lid 39 of a pressure-resistant explosion-proof electric motor 44 is screwed to the underside of the base plate 32 of the terminal box 30, which upper lid iS at the underside provided with annular grooves 40 and 41 for fitting respective O-rings 42 and 43 therein. An inner case 44*a* of the pressure-resistant explosion-proof electric motor 44 is disposed such that its upper end pressure-contacts the O-ring 42, while an outer case 45 of the electric motor 44—which is at the upper and lower ends provided with respective flange portions 45*a* and 45*b*—has its flange portion 45*a* pressure-contacted with the O-ring 43 (FIG. 2).

Spiral ribs 46 are provided on an outer peripheral surface of the inner case 44a of the electric motor 44, with which spiral ribs is contacted an inner peripheral surface of the outer case 45 to provide a double casing and a motor-cooling oil passage 54 inside the double casing (FIG. 2).

The cooling-oil inlet pipe 52*a* (FIG. 1) is connected to a cooling-oil inlet 52 (FIG. 2) provided in a lower lid 47 of the electric motor 44, which cooling-oil inlet communicates through an annular passage 53, an oil passage 55 and an upwardly-directed oil passage 56 to a lower end portion of the motor-cooling oil passage 54.

An upper end portion of the motor-cooling oil passage 54 communicates via an oil passage 57 provided in the flange portion 45*a* of the outer case 45 to an oil passage 58 in the upper lid 39, which oil passage 58 communicates to the cooling-oil outlet pipe 29 which connects to a cooling-oil outlet 58*a* (FIGS. 1 and 2).

A stator 59 is provided inside the inner case 44*a* of the electric motor 44, and a rotor 61 fixed around the output shaft 60 of the electric motor 44 is disposed inside the stator 59.

An electric wire 62 extends from the stator 59 to be electrically connected with the electric wire cable 38 at the terminal mount 36.

A bearing 63 is provided at the upper lid 39 of the electric motor 44 for supporting the output shaft 60 at the upper end, and a bearing 64 is provided along with a shaft seal packing 65 at the lower lid 47 for supporting the output shaft 60 at a lower portion (FIG. 2). The lower end of the output shaft 60 is machined into a male spline 66.

A facing flange 68 of an centrifugal pump 67 is joined to the underside of the lower lid 47 of the electric motor 44, and the joint is made watertight by means of an O-ring or the like (FIG. 3).

A cylindrically-shaped motor cover 69 is provided around the electric motor 44 such that its lower end surface contacts the facing flange 68 of the centrifugal pump 67 in a watertight manner.

An upper cover 70 is fixed to the Upper end of the motor cover 69, which upper cover is provided with a hole in which the lower end portion of a protective pipe 71 is fitted (FIG. 1). The protective pipe 71 is at the upper end fixed to the flange 26.

Thus, an air chamber 72 is formed inside the protective pipe 71 and the motor cover 69, which air chamber accommodates therein the downwardly-extending pipe 28, terminal box 30 and pressure-resistant explosion-proof electric motor 44 in a watertight manner.

A bearing case 73 is fitted to the facing flange 68, and the joint is made watertight by an O-ring. The rotary shaft 76 of the centrifugal pump 67 is supported by an upper bearing 74 and a lower bearing 75 each provided at the bearing case 73 (FIG. 3).

A cover case 77 is provided outside the bearing case 73 to cover same, and a pump case 78 is fixed to the lower end of the bearing case 73.

The pump case 78 is provided with a suction port 12 for sucking in liquid and with a discharge port 80 for discharging the liquid, to which discharge port is connected a discharge pipe 81 for discharging the liquid outside the tank T (FIG. 3).

The rotary shaft 76 is at the upper end provided with a female spline 76*a* for engagement with the male spline 66 of the output shaft 60 and at the lower end provided with impeller 82.

A packing case 83 is provided which is fixed to the bearing case 73 inside the pump case 78.

A hermetically sealed air chamber 88 is formed inside the packing case 83, in the interior of which air chamber a shaft seal packing portion 84 is provided for sealing the rotary shaft 76 (FIG. 3).

A bearing-lubricating oil passage is made up of a branch pipe 85 communicating from the annular passage 53 of the lower lid 47 to the lower bearing 75 of the bearing case 73, a lubricating oil passage 86 communicating from the lower bearing 75 to the upper bearing 74, and a cooling oil passage 87 communicating from the upper bearing 74 to the annular passage 53 (FIG. 3).

The operation of the thus constructed electrically-powered water-immersed pump B will now be described.

The flange 26 of the electrically-powered water-immersed pump B is fitted to the top surface of the tank T so that the protective pipe 71, motor cover 69 and centrifugal pump 67 extend into the tank, followed by the mounting of a power source, a cooling oil delivering pump and an air pressure source on the top surface of the tank T.

A watertight air chamber 72 is continuously formed inside the protective pipe 71 and the motor cover 69, and the downwardly-extending pipe 28, terminal box 30 and pressure-resistant explosion-proof electric motor 44 contained in the air chamber 72 are protected from the ambient liquid.

Owing to the non-presence of intermediate shafts and their supporting bearings as in the prior art, the electrically-powered water-immersed pump B is relatively light in weight.

Since the electric motor 44 is enclosed by a double casing made up of the inner and outer cases 44*a* and 45, the running sound of the electric motor is effectively insulated.

The spiral motor-cooling oil passage 54 formed by the ribs 46 in the double casing serves to increase the cooling effect by the cooling oil.

By operating the electric motor 44, the centrifugal pump 67 is rotated. If the pump 67 is rotated, the liquid in the tank T is discharged through the discharge port 80 of the centrifugal pump 67 and the discharge pipe 81 to the outside of the tank T.

The cooling oil delivering pump disposed outside the tank T supplies the cooling oil through the cooling oil inlet pipe 52*a* to the motor-cooling oil passage 54, where the cooling oil flows along the spiral ribs 46 to efficiently remove the heat generated from the electric motor 44. Consequently, the electrically-powered water-immersed pump B can be operated for a long period of time.

Figure 5:
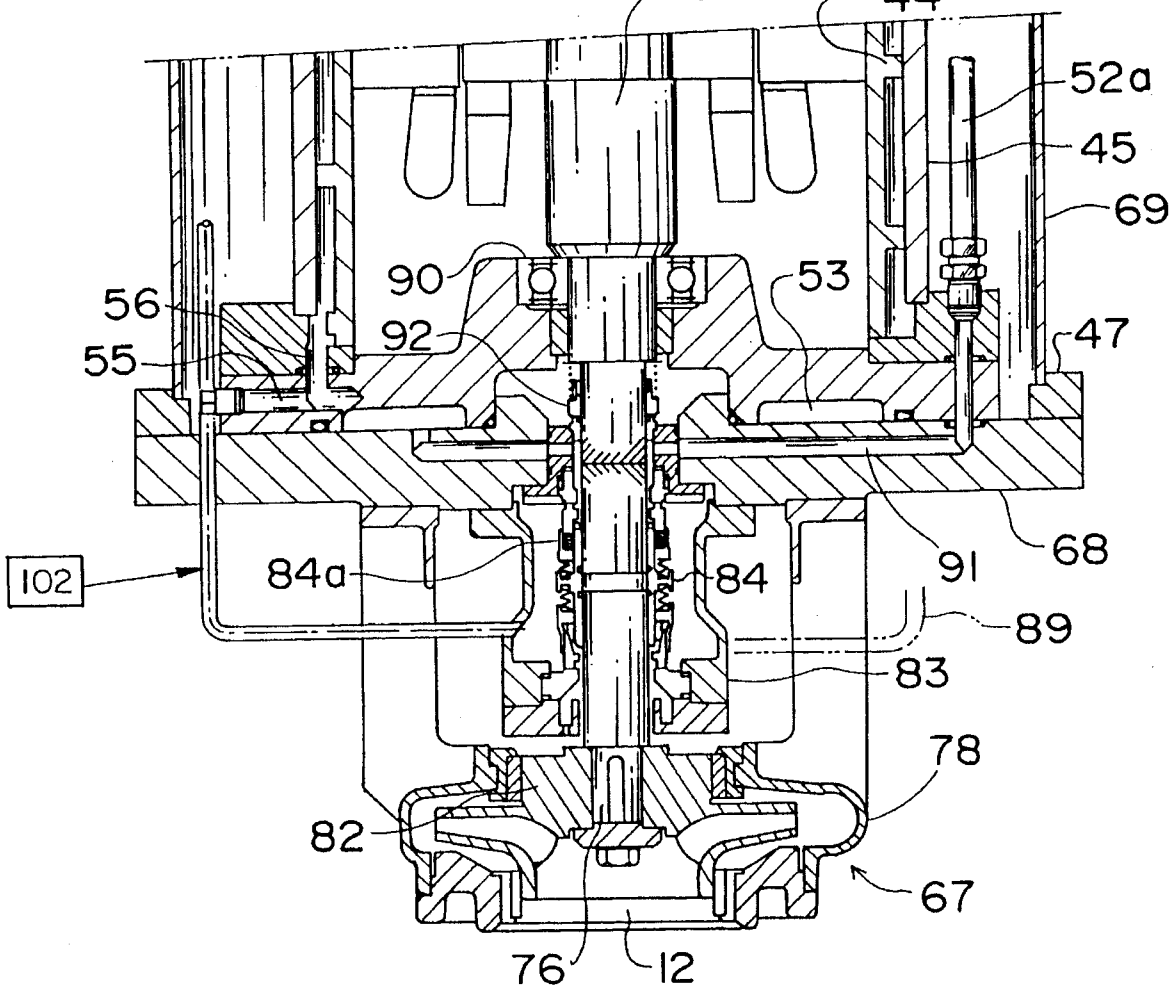
FIG. 5 is a longitudinal sectional view of an essential portion of an electrically-powered water-immersed pump according to another embodiment of this invention.
Figure 6:
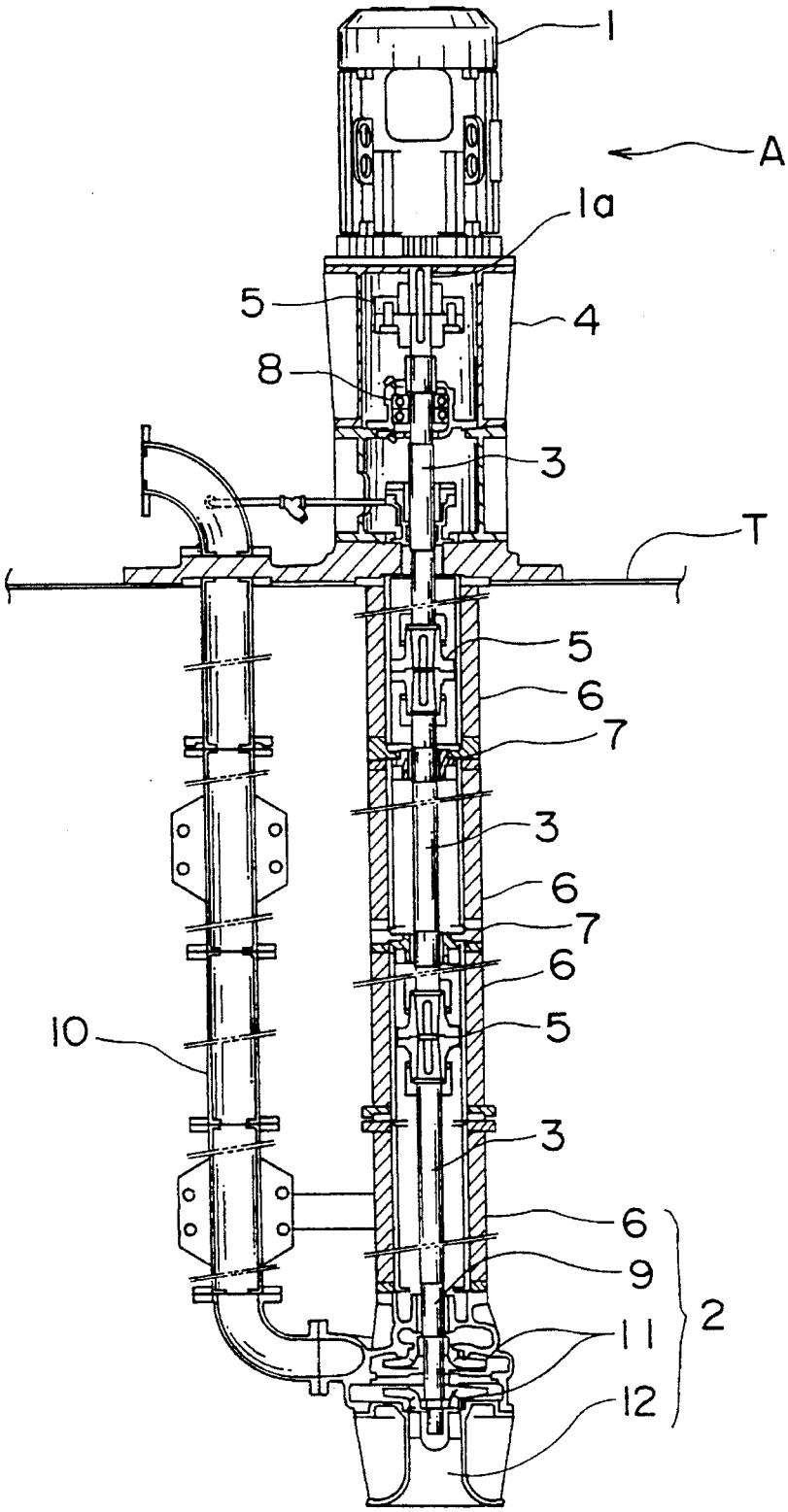
FIG. 6 (PRIOR ART)
FIG. 6 is a longitudinal sectional view of a conventional electrically-driven cargo handling pump.
Figure 7:
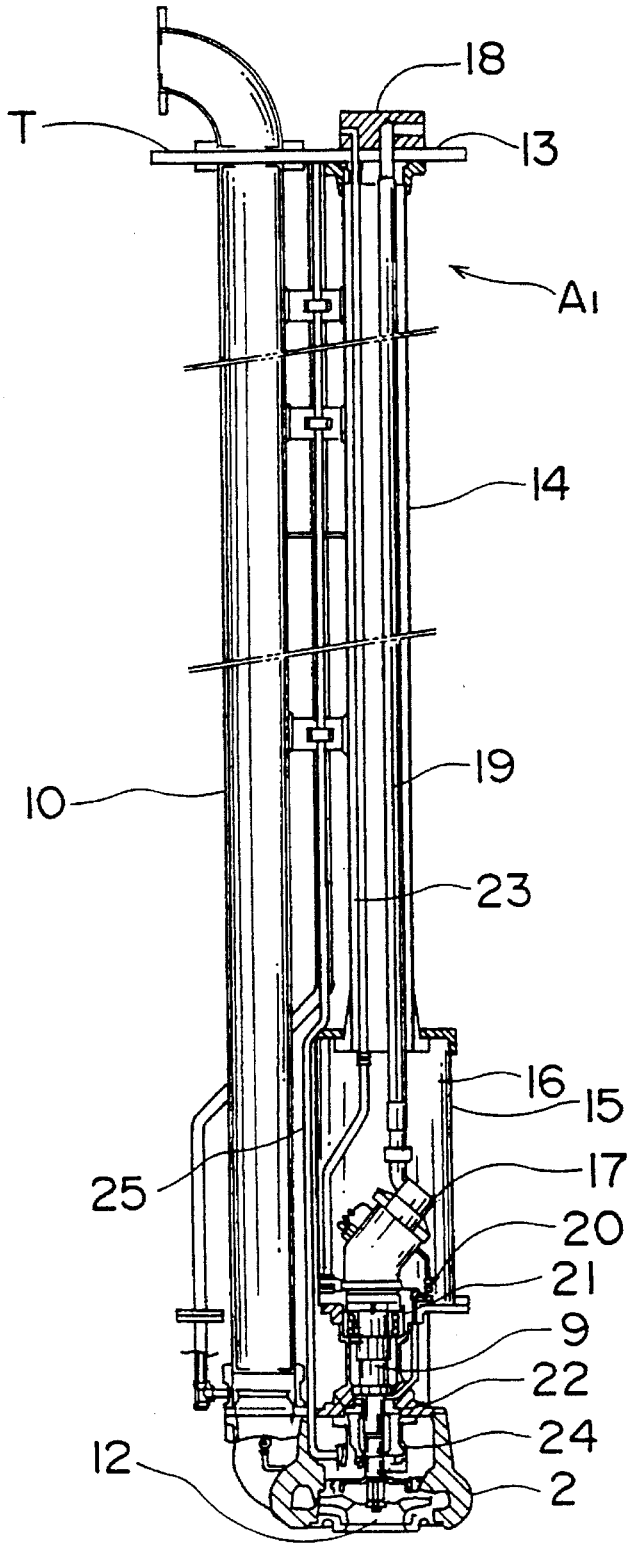
FIG. 7 (PRIOR ART)
FIG. 7 is a longitudinal sectional view of a conventional hydraulically-driven cargo handling pump.

Referring to FIG. 5, if the output shaft 60 of the electric motor 44 is extended to include the rotary shaft 76 of the pump 67 as an integral part thereof, the bearing case 73 and the bearings 74 and 75 as shown in FIG. 3 can be omitted. Further, an error in the concentricity of the shafts can be prevented.

The output shaft 60 of the electric motor 44 is generally made of carbon steal, while it is required that the rotary shaft 76 of the pump 67 is made of stainless steal.

Thus, if the output shaft 60 of the electric motor 44 and the rotary shaft 76 of the pump 67 are to be integrally united as shown in FIG. 5, the ends of both shafts are subjected to pressure welding or welding to be joined together.

The joint of both shafts as referred to above is located upwardly of a shaft seal 92 for sealing the output shaft 60 against the cooling oil, or at an intermediate position between the shaft seal 92 and an upper portion 84a of a shaft seal packing portion 84.

With the construction as described hereinabove, the following advantages can be obtained.

(1) A solution has been given to the drawbacks to the conventional electric motor-driven pump such as the increase in the overall weight, the generation of vibrations and the damage to the bearings and the like.

(2) A solution has been given to the drawbacks to the conventional hydraulic motor-driven pump such as the generation of noises, the low mechanical efficiency and the like.

(3) Since the electrically-powered water-immersed pump of this invention is small in size and of simple structure, its maintenance, disassembly and assembly as well as its transportation and installation can be easily done.

The pump of this invention has an advantage that its mechanical efficiency during operation is higher than that of the hydraulic motor-driven pump.

(4) Since in the electrically-driven water-immersed pump of this invention the pressure-resistant explosion-proof electric motor is enclosed by a casing of double structure having the cooling oil passage formed therein, there are obtained advantages that the running sound of the electric motor is less noisy and that, since a rise in temperature is suppressed, a long period of no-open operation of the pump is possible.

What is claimed is:

1. An electrically-powered water-immersed pump comprising:

a pressure-resistant explosion-proof electric motor enclosed by a double casing comprised of inner and outer cases with a motor-cooling oil passage formed therebetween, said outer case being at upper and lower ends closed in a watertight manner respectively by upper and lower lids between which an output shaft of said electric motor is rotatably held;

a flange detachably fitted to a top surface of a tank containing a liquid to be transferred;

a downwardly-extending pipe which is at an upper end fixed to said flange and at a lower end connected through a terminal box to said electric motor;

a pump with a casing which is at an end surface fixed to an underside of said electric motor and with a rotary shaft which is connected to said output shaft of said electric motor;

a cylindrically-shaped motor cover immersed in the liquid in the tank and accommodating therein said electric motor and said terminal box in a watertight manner;

a protective pipe extending from the flange to an upper end of said motor cover and accommodating therein said downwardly-extending pipe in a watertight manner;

a cooling-oil inlet pipe which communicates from a cooling-oil delivering pump located outside the tank through said flange to said motor-cooling oil passage inside said double casing of said electric motor;

a cooling-oil outlet pipe which extends from said motor-cooling oil passage through said flange to open to the outside of the tank; and an electric cable which extends from a power source located outside the tank through said flange and said terminal box to said electric motor.

2. An electrically-powered water-immersed pump according to claim 1, wherein spiral ribs are provided on an outer peripheral surface of said inner case to form said motor-cooling oil passage.

3. An electrically-powered water-immersed pump according to claim 1, further comprising a lubricating oil passage extending from said cooling-oil inlet pipe for lubricating a bearing for said rotary shaft of said pump.

4. An electrically-powered water-immersed pump according to claim 1, further comprising a packing case which encloses therein a shaft seal packing portion for said rotary shaft of said pump in a watertight manner; a branch pipe extending from said cooling-oil inlet pipe to said shaft seal packing portion; a drain pipe communicating from said packing case to the outside of the tank; and an air pressure passage provided to communicate from outside the tank through said motor cover to the packing case, whereby the drain of the cooling oil leaked from said shaft seal packing portion is discharged by the air pressure through said drain pipe.

5. An electrically-powered water-immersed pump according to claim 1, wherein said rotary shaft of said pump is mechanically integrally connected to an end of said output shaft of said electric motor.

6. An electrically-powered water-immersed pump according to claim 1, wherein end surfaces of said rotary shaft of said pump and of said output shaft of said electric motor, which are made of different materials, are subjected to welding to be joined together.

* * * * *